US006405001B1

(12) United States Patent
Sumiyoshi

(10) Patent No.: US 6,405,001 B1
(45) Date of Patent: Jun. 11, 2002

(54) POWER-SAVING TYPE ELECTROPHOTOGRAPHY APPARATUS SUITABLE FOR USE WITH OPTIONAL UNIT HAVING EXCLUSIVE POWER SUPPLY

(75) Inventor: Michio Sumiyoshi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/685,085

(22) Filed: Oct. 11, 2000

(30) Foreign Application Priority Data

Oct. 15, 1999 (JP) ..... 11-293405

(51) Int. Cl.[7] ..... G03G 15/00
(52) U.S. Cl. ..... 399/88
(58) Field of Search ..... 399/9, 13, 18, 399/23, 70, 75, 82, 85, 88, 364, 407, 408, 409, 410; 395/112, 101

(56) References Cited

U.S. PATENT DOCUMENTS 5,963,755 A * 10/1999 Ueda et al. ..... 399/23
6,072,585 A * 6/2000 Dutton et al. ..... 399/89 X

FOREIGN PATENT DOCUMENTS

JP 409188037 * 7/1997

* cited by examiner

*Primary Examiner*—Sophia S. Chen
*Assistant Examiner*—Hoan Tran
(74) *Attorney, Agent, or Firm*—Antonelli, Terry, Stout & Kraus, LLP

(57) ABSTRACT

In order to provide a color electrophotography apparatus satisfying a power-saving specification fully by turning off the power supply to various parts so as to reduce the watt consumption when the parts are unnecessary, such as in a power-saving mode, the duplexer, which is optional to the color electrophotography apparatus, has a unit to indicate to the control device of the color electrophotography apparatus whether or not the electric power is to be fed from an electric power supply in the color electrophotography apparatus.

11 Claims, 6 Drawing Sheets

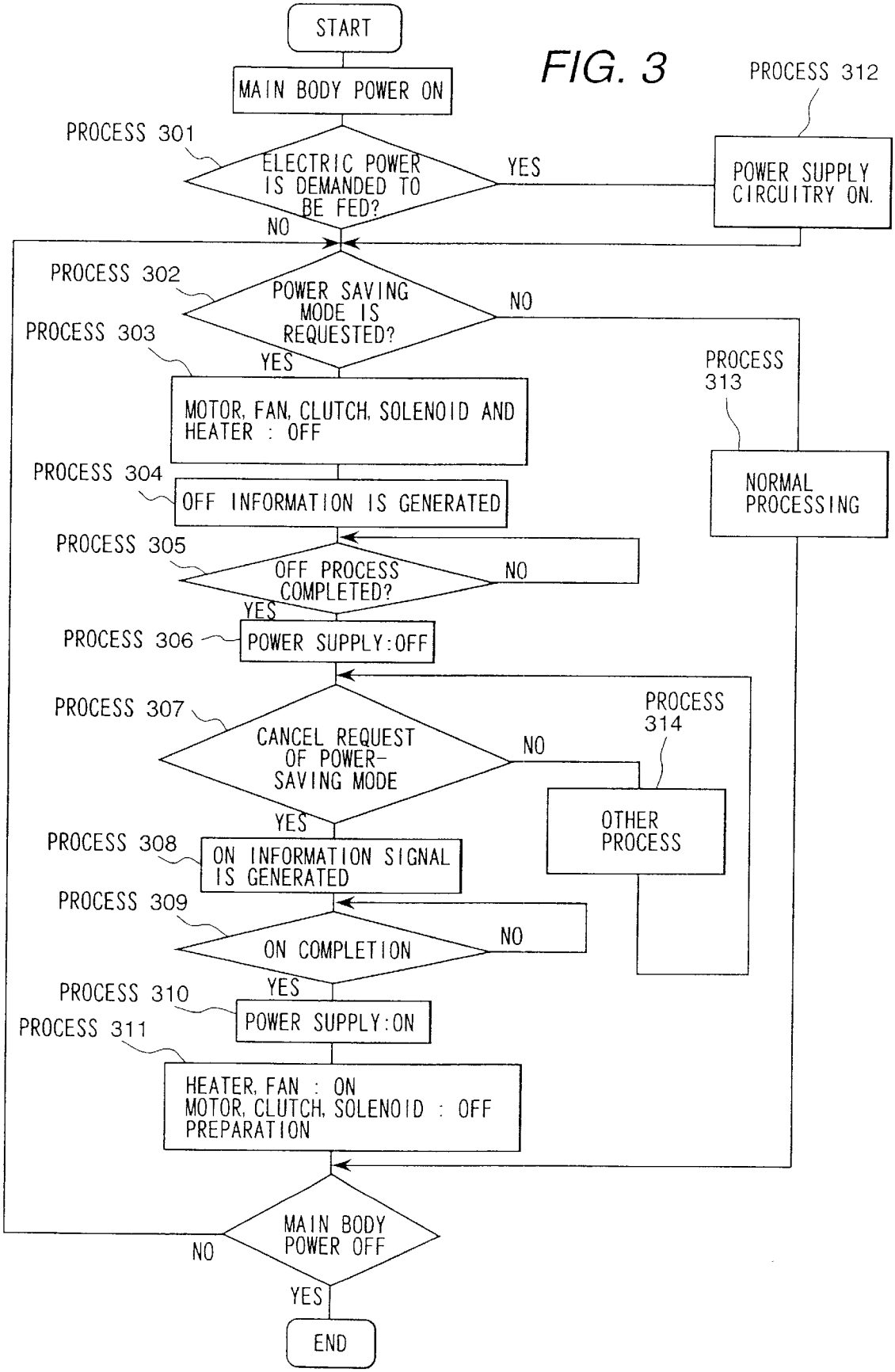
FIG. 3
START
MAIN BODY POWER ON
PROCESS 301
ELECTRIC POWER IS DEMANDED TO BE FED?
YES
NO
PROCESS 312
POWER SUPPLY CIRCUITRY ON.
PROCESS 302
POWER SAVING MODE IS REQUESTED?
NO
YES
PROCESS 303
MOTOR, FAN, CLUTCH, SOLENOID AND HEATER : OFF
PROCESS 313
NORMAL PROCESSING
PROCESS 304
OFF INFORMATION IS GENERATED
PROCESS 305
OFF PROCESS COMPLETED?
NO
YES
PROCESS 306
POWER SUPPLY:OFF
PROCESS 307
CANCEL REQUEST OF POWER-SAVING MODE
NO
PROCESS 314
OTHER PROCESS
YES
PROCESS 308
ON INFORMATION SIGNAL IS GENERATED
PROCESS 309
ON COMPLETION
NO
YES
PROCESS 310
POWER SUPPLY:ON
PROCESS 311
HEATER, FAN : ON
MOTOR, CLUTCH, SOLENOID : OFF
PREPARATION
MAIN BODY POWER OFF
NO
YES
END

POWER-SAVING TYPE ELECTROPHOTOGRAPHY APPARATUS SUITABLE FOR USE WITH OPTIONAL UNIT HAVING EXCLUSIVE POWER SUPPLY

BACKGROUND OF THE INVENTION

The present invention relates to an electrophotographic printer, such as a laser beam printer, or an electrophotography apparatus such as an electrophotographic copier. More particularly, the invention relates to an electrophotography apparatus having an intermediate transfer body, and which is suitable for use with an optional unit.

Generally, in a method of producing a color image in an electrophotography apparatus having an intermediate transfer body, an electrostatic latent image on a photoconductive body is developed by a development providing toner apparatus of different colors, a developed toner image of a first color is transferred to the surface of the intermediate transfer body, and further color toner images are superimposed thereon. Then, the composite color toner image on the intermediate transfer body is transferred to a sheet of paper conveyed by a transportation mechanism.

In a color electrophotography apparatus having an intermediate transfer body of this type, the toner images on the photoconductive body are transferred first to the intermediate transfer body from a photoconductive body, and then they are again transferred as a composite image, from the intermediate transfer body to a sheet of paper so as to form a pictorial image thereon, and the color toner image on the paper is heated and fixed by a fixing apparatus after that, so that is can be transported to the outside of the apparatus.

Furthermore, in a color electrophotography apparatus having a duplexer, after the first color toner image on the paper (A side) is heated and is fixed by the fixing apparatus, this paper is turned over in the duplexer, and the paper is conveyed by the transportation mechanism of the color electrophotography apparatus so that a second color toner image can be printed on the back side (B side) in the same way as on the A side.

Furthermore, in recent years, in consideration for the environment, a trend toward energy saving has become conspicuous, and so specifications which emphasize power-saving has become important. For example, in accordance with Energy Star, a power consumption of less than 45 W, for example, is required in a state where an apparatus is in a standby or power-saving mode.

In a conventional color electrophotography apparatus, a voltage power supply of 5V is used in order to drive a control device (a control circuit board), an optical sensor, a display device etc., while a high voltage power supply of 24V, which is higher than the 5V with relationship of efficiency, is used to drive an actuator, such as a motor, a fan, a clutch, a solenoid etc., and there are many cases involving various power supplies.

In the power-saving mode, because it is not necessary for the apparatus to operate, all actuators and the heater in the fixing unit are turned off, so that the power consumption is reduced. In addition, the 24V power supply may be turned off. However, the 5V power supply for driving the control device (including the CPU) cannot be turned off, and other parts, such as the sensors using the 5V power supply, in many cases cannot be turned off. During all of the power-saving mode time, a display unit to display the state of the instruments to an operator can not be turned off for security or operational reasons. In a case where an optional apparatus, such as a duplexer or a sorter, is employed in the color electrophotography apparatus as part of the main body, the energy consumption for each optional apparatus can not be increased in most cases.

In a system including an optional apparatus, it is necessary to maintain a predetermined power-saving specification. On the other hand, where the main body of the color electrophotography apparatus already has a very small margin for the power-saving specification value, a reduction of the power consumption of the main body should be improved. In a case of plural optional apparatuses, or when much energy is used for the optional apparatus itself, there is a limit to use of all of the optional apparatuses and still meet the power-saving specification value. As a means to solve such a problem, Japanese Patent Laid-open No. 9-188037 discloses a method in which a power supply provided in an optional apparatus is cut off when use of the operational apparatus is unnecessary. However, in cases of the control device, which includes a CPU, in the optional apparatus, a problem, such as a malfunction may occur, when the power supply of the optional apparatus is cut off.

Therefore, in the conventional color electrophotography apparatus, there is a problem in that there is a condition in which the apparatus cannot satisfy the power-saving specification fully.

SUMMARY OF THE INVENTION

The object of the present invention is to provide an electrophotography apparatus in which the above stated problems are eliminated.

In order to achieve the above object, the present invention provides an electrophotography apparatus comprising a main body having an exposure means to generate a light flux, a photoconductive body for forming a latent image using said light flux, a development device for developing said latent image on said photoconductive body, a transfer device for transferring an image developed by said development device onto a recording medium, and a fixing device for fixing said image on said recording medium, wherein said electrophotography apparatus further includes an optional apparatus which is capable of being mounted on said main body, wherein said main body transmits a switching over instruction to said optional apparatus according to the kind of said optional apparatus when said optional apparatus is mounted on said main body, and a power source system of said optional apparatus is switched over by said switching over instruction.

Furthermore, the present invention provides a color electrophotography apparatus comprising a photoconductive body for forming an electrostatic latent image according to print data classified according to color; plural development units for performing a toner development with said electrostatic latent image; an intermediate transfer body receiving said toner images developed by said development units so as to maintain each image and stack color images; a transportation means to convey paper on which said color toner image on said intermediate transfer body is to be transferred; a transferring apparatus for transferring said color toner image on said intermediate transfer body onto said paper conveyed by transportation means; a discharging apparatus to separate the paper from said intermediate transfer body after said toner image is transferred to said paper by said transferring apparatus; a fixing means to heat and fix said toner image on said paper firmly; and a control device to control each component of the printer; said color electrophotography apparatus further having a duplexer constituted as an optional device to this color electrophotography apparatus for turning over said paper on which said first toner image has been printed and for conveying said paper to said transportation means of said color electrophotography apparatus again, wherein said duplexer has a control device for its exclusive use and an electric power supply for its exclusive use inside of said duplexer. Furthermore, the electric power supply in accordance with the present invention has a circuit structure to selectively feed or cut off the electric power to each component in the duplexer based on control by the control device in said color electrophotography apparatus.

The circuit structure operates to selectively feed said electric power for each component of said duplexer from the electric power supply provided in said color electrophotography apparatus, and said color electrophotography apparatus has a structure to select whether said electric power is fed from the electric power supply provided in said duplexer or from the electric power supply provided in said color electrophotography apparatus. Furthermore, said duplexer indicates to said control device of said color electrophotography apparatus whether said electric power is to be fed or not from said electric power supply of said color electrophotography apparatus according to the constitution of said duplexer.

The control device of said color electrophotography apparatus has a detection means to detect whether said duplexer is to be connected or not connected to said color electrophotography apparatus, and to detect whether said power is to be fed or not fed from said color electrophotography apparatus to each component, whereby said color electrophotography apparatus detects a condition of said duplexer, and in response to the detected condition, said power supply is selected.

The control device of said color electrophotography apparatus has a detection means to detect whether said duplexer is to be connected or not connected to said color electrophotography apparatus, wherein, when said color electrophotography apparatus is in a power-saving mode so that said duplexer is not being operated, said power supply in said duplexer is switched off according to said control signal.

Furthermore, information is transferred from said control device in said color electrophotography apparatus to said control device in said duplexer beforehand, before said circuit structure selects feed/cut of said electric power.

In addition, said electric power supply inside of said duplexer, for its exclusive use, is controlled so that power is fed or cut off at the AC input unit of the first side of the electric power supply. For other units mounted as an option additionally, a similar power supply is constituted.

An optional unit such as an exclusive power supply to supply power to each part in the duplexer, is provided in said duplexer, and the electric power is fed or cut off from the unit power supply to each component in the unit using a control signal of the control device in the color electrophotography apparatus. Generally when feed/cut of the electric power is performed in the secondary side of the power supply (5V/24V generation part), even if there is not any supplied power from the secondary side, the electric power is consumed by a loss on the primary side. That is to say, even if, the power supply to an interior part of the unit is stopped by cutting off the secondary circuit, the electric power is consumed in the power supply, and, as a result, a bad influence is exhibited on the power-saving specification value.

In contrast, in accordance with the present invention, the feed/cut off of operation of the unit power supply is performed at the primary side AC input unit of the power supply, so that a condition can be achieved such that any useless power supply does not exist. As the optional unit receives the information of enforcement before the unit power supply is selected to feed/cut off said electric power, for example, when there is a control device having a CPU in the optional unit, the cut/feed of the electric power can be prepared for each component beforehand. On this account, when the function of the unit is unnecessary, for example, in a power-saving mode, when the exclusive power supply in the optional unit is switched off, the power consumption of the system can be reduced, and malfunction of each component in the unit can be prevented.

BRIEF DESCRIPTION OF THE DRAWINGS

FIGS. 2A, 2A-1 and 2B are schematic block diagrams showing in more detail the control device in the duplexer of a color laser beam printer, which represents an embodiment of the present invention.

FIG. 3 is a flow chart of a control program for the control device in a color laser beam printer, which represents an embodiment of the present invention.

DETAILED DESCRIPTION OF THE PREFERRED EMBODIMENT

An example of a color laser beam printer, represents one type of which is a color image electrophotography apparatus, according to an embodiment of the present invention, will be explained with reference to the drawings.

Figure 5:
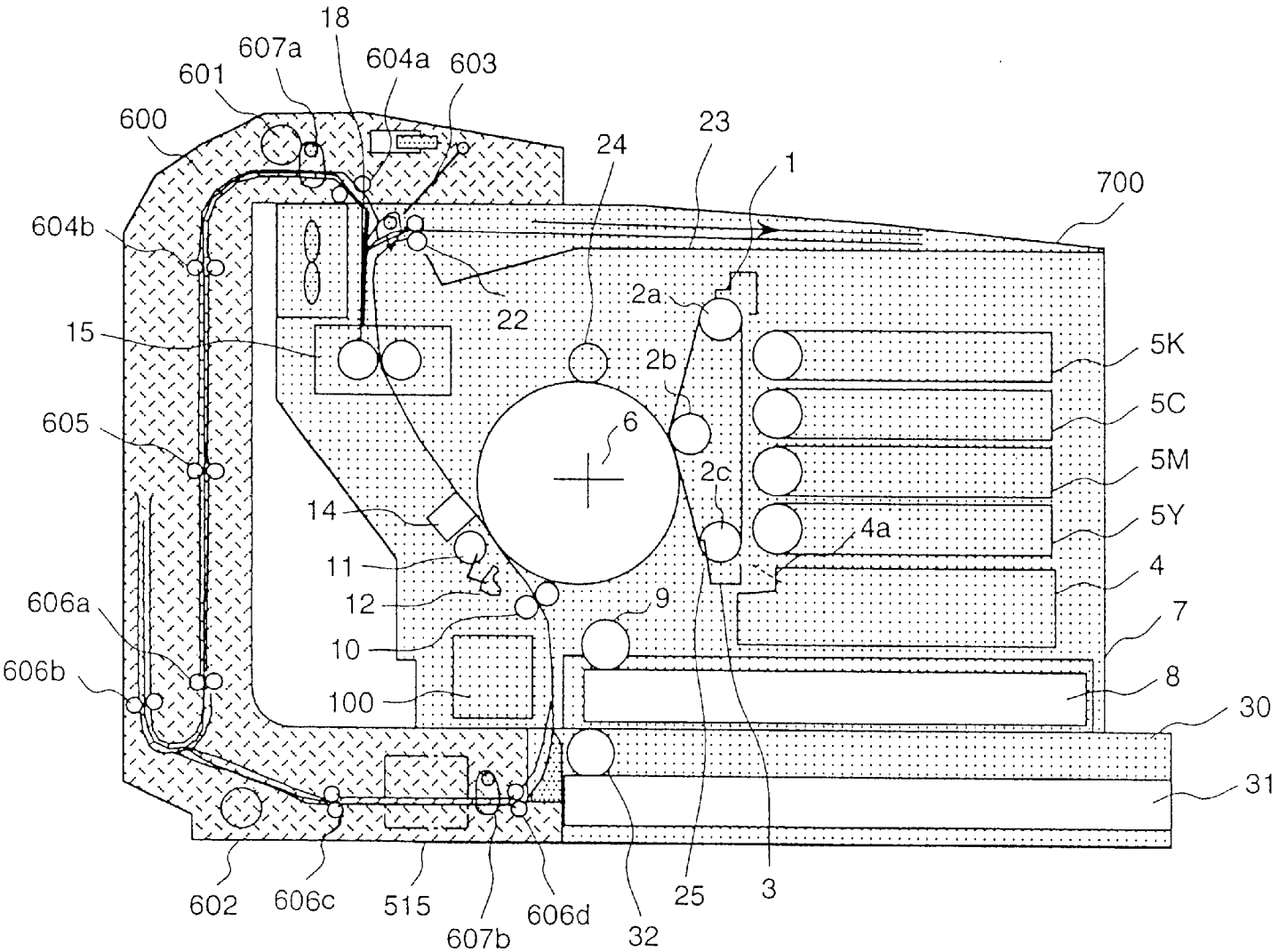
FIG. 5 is a longitudinal sectional view of a color laser beam printer of the type to which the present invention is applied.

FIG. 5 is a longitudinal sectional side-view of the color laser beam printer on which a duplexer is mounted.

The apparatus has a color laser beam printer main body 700, a second paper feeding cassette 30 and the duplexer 600. Although not explained in detail here, when this duplexer 600 is connected with the color laser beam printer body 700, there is a way to connect it to the color laser beam printer main body 700 without changing the constitution thereof, and a way to connect it by partially changing the constitution thereof.

This drawing shows the constitution of the apparatus after each unit has been connected, and the features relating to the connection method are not illustrated.

When the duplexer 600 is connected to the color laser beam printer body 700, the necessity or not that does not do it is not asked you it is added to the color laser beam printer body 700 without a relation whether any change is needed for the color laser beam printer body 700. It is assumed here that it is added to the duplexer, as will be explained in detail afterward. Without prescribing the duplexer especially, it may be applied to an option unit to be added to the color laser beam printer body.

At first, a case in which printing occurs only on one side of a paper 8 (A side) will be described with reference to use of a laser beam printer without using a duplexer.

A photoconductive belt 1 forming a photoconductive body is rotated with a constant velocity around guide-rollers 2*a*, 2*b* and 2*c*, and the surface thereof is charged uniformly by an electrostatic charge device 3. The charged surface is exposed by a laser light 4*a* provided from exposure equipment 4 according to picture signals for respective colors of an image, and electrostatic latent images corresponding to reach respective color are s formed sequentially on the photoconductive belt. The electrostatic latent images are developed sequentially by a development apparatus using developer of respective colors dispensed from four development devices 5Y, 5M, 5C, 5K, whereby respective toner images of each color are formed on the photoconductive belt 1. The toner images in the respective colors on this photoconductive belt 1 are copied onto the surface of a drum 6, that operates as an intermediate transfer body rotating in synchronism with and in contact with the surface of the photoconductive belt 1, whereby a color toner image is provided on the surface of the transfer drum 6.

A sheet of paper 8 that represents a recording medium supplied from a paper feeding cassette 7 is extracted and conveyed by a paper feeding roller 9 and a register roller 10 toward a transfer roller 11, after being adjusted and controlled to provide the required transportation timing to effect proper registration of the color toner image on the surface of the transfer drum 6 with the arrival of the paper.

Numeral 30 denotes a second paper feeding cassette, from which a paper 31 is sent to the register roller 10 in the same way as the paper 8, after being extracted and conveyed by the second paper feeding roller 32.

The transfer roller 11 constitutes one part of the transfer apparatus, which causes the paper 8 to contact the transfer drum 6, so that the color toner image on the surface of the transfer drum 6 is transferred to the paper 8 (A side), by applying a mechanical pressure to the paper from a backside thereof while applying a transfer electric field. Further, the transfer roller 11 is moved away from the transfer drum 6 by a transfer roller switching apparatus 12 so as to reside at a shunt position during the time when the color toner image is being formed by transferring the toner images of respective colors on the photoconductive belt 1 to the surface of the transfer drum 6; whereas, the switching apparatus 12 operates to move the transfer roller 11 toward and into contact with the transfer drum 6 after formation of the color toner image on the transfer drum 6 is completed so as to transfer the color toner image to the paper 8. It should be noted that the transfer voltage applied to the transfer roller 11 in order to generate a transfer electric field is fed by a high voltage power supply 13 that is not shown in the figure.

In an AC discharging device 14 that operates as a discharging apparatus for producing an alternating current corona, an alternating voltage for producing the discharge corona can be changed continually and arbitrarily according to a duty ratio of an input signal, and is supplied by a high voltage power supply 13. The paper 8 is striped from the transfer drum 6 by neutralizing the charge remaining on the back of the paper 8 on which the color toner image is copied using the discharging device 14. The paper 8 that is striped from the transfer drum 6 is sent to a fixing apparatus 15, and the color toner image is fixed on the surface of the paper 8 by heat while passing through the fixing apparatus 15. The paper 8 on which the fixed color toner image is carried is discharged to a paper eject tray 23 after passing through an output roller 22.

A belt cleaner 25 removes any toner remaining on the surface of the photoconductive belt 1, and a drum cleaner 24 removes the toner remaining on the surface of the transfer drum 6. Further, the drum cleaner 24 is raised up so that the cleaning operation does not occur during the process of forming the color toner image on the transfer drum 6 by repeatedly transferring a monochrome toner image from the photoconductive belt 1 onto the surface of the transfer drum 6, and it is pressed against the surface of the transfer drum 6 after the completed color toner image on the transfer drum 6 has been transferred to the paper 8.

A control device 100, which will be described in more detail later, controls each operational element of the color laser printer according to an input signal from the control panel 50, that is not shown in the figure, and in response to an input signal from an information processor 200, to be described later.

A case in which the duplexer 600 is used to effect printing on the B side of the paper 8 will be described next.

In the duplexer 600, there are provided drive motors 601 and 602 to convey the paper; a transportation path change means 603 for changing the path of a paper supplied from the fixing apparatus 15 to either direct the paper to the eject tray 23 or to direct the paper to the duplexer 600; duplexer feed rollers 604*a*, 604*b* which are driven by the drive motor 601; a duplexer register roller 605; feed rollers 606*a*, 606*b*, 606*c*, 606*d*, which are driven by the drive motor 602; and paper sensors 607*a*, 607*b*, which detect the feed of the paper. When the paper 8 that is supplied from the fixing apparatus 15 of the color laser beam printer is sent to a feed roller 604*a* side by the transportation path change means 603, the paper 8 enters the duplexer 600. The paper sensor 607*a* watches for the paper 8 to be conveyed in the duplexer. The paper stops first at the duplexer register roller 605 after that, and after it has been adjusted, it is transported again. When the tip of the paper 8 has reached the feed roller 606*a*, it turns back toward the feed roller 606*b*. When the rear end of the paper 8 reaches a predetermined location in front of the feed roller 606*b*, the direction of rotation of the drive motor 602 is reversed, so that the driving direction of the feed roller 606*b* is inversed, and the rear end of the paper becomes the tip of the paper in the duplexer 600, and it is conveyed in this reversed state.

Then, after the paper passes near the paper sensor 607*b*, the rollers 606*b*, 606*c*, 606*d* stop after a predetermined time from this point as a starting point. The timing is matched with the operation of the color laser beam printer main body; and, after that, the feed rollers 606*b*, 606*c*, 606*d* are rotated, the paper is conveyed to the register roller 10, and then the feed rollers 606*b*, 606*c*, 606*d* stop their rotation. Thereafter, the B side of the paper 8 is printed by a method similar to that of the A side thereof, as described above.

Figure 1:
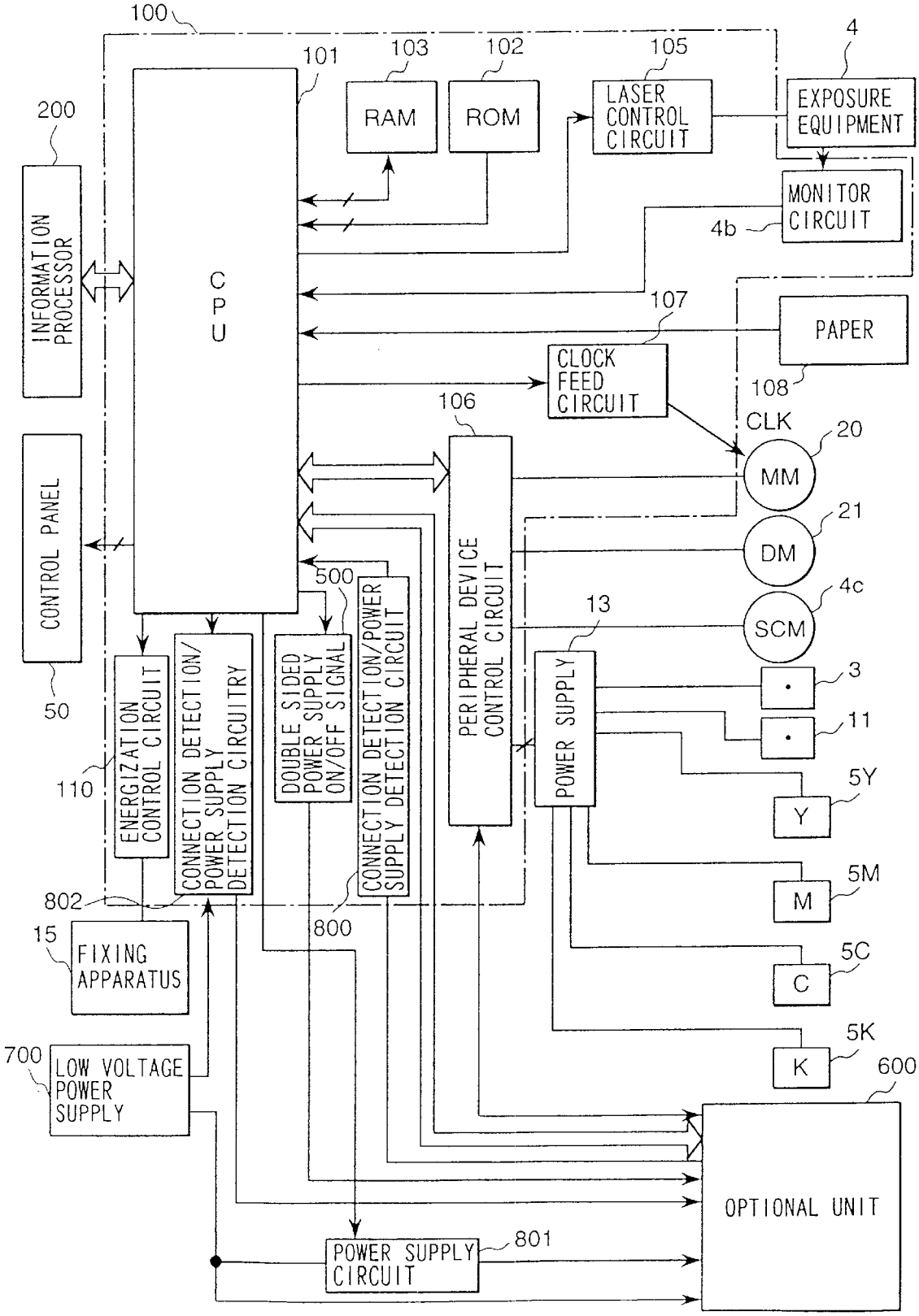
FIG. 1 is block diagram of a control device for a color laser beam printer, which represents an embodiment of the present invention.

FIG. 1 is a block diagram showing in more detail the control device 100 of the color laser beam printer. The control device 100 is mainly formed of a CPU 101, a read only memory 102 that stores a control program for the CPU 101, and a random access memory 103 operating as a memory device for storing the work which is necessary for the CPU 101 to execute in response to the control program.

The CPU 101 communicates with the information processor 200 such as a word processor or a personal computer, and the print data produced by the information processor 200 is communicated to an exposure control part (laser control circuit) 105. The exposure control part 105 controls the exposure equipment 4 and generates the laser light 4*a*. The CPU 101 is also connected to a control panel 50.

A peripheral device control circuit 106 operates as a control part to control a mechanism group which carries out the electrophotography process. A voltage control signal is provided by the control circuit 106 for controlling the drive of each motor, and an outbreak voltage of a power supply 13 for a high voltage is output in response to control by the CPU 101. A clock feed circuit 107 supplies a clock signal to control the timing of a main motor 20 to drive the photoconductive belt 1, the transportation roller 9 and the fixing apparatus 20. A development motor 21 drives each development device.

A paper sensor assembly 108 has a paper detection sensor arranged at the top of the paper transportation path in order to indicate the transportation condition of the paper 8, and those signals from the paper detection sensor are input to the CPU 101. An energization control circuit 110 serves as an energization control means to energize a heating conductor 18 in the fixing apparatus 15. A low voltage power supply 700 supplies electric power to the control device 100 and various peripheral device driving parts, and partially to the duplexer 600.

As an optional connection detection/power supply detection circuit 800 there is provided a circuit to detect whether or not the optional unit is connected to the printer body, and furthermore, to determine whether or not the unit 600 needs to be fed electric power. When the optional unit 600 needs to be fed electric power, the power supply circuit 801 is operated by the CPU 101, so that electric power is supplied to the optional unit 600.

A double phase power supply on/off signal 500 is used to connect or to cut off the power supply provided in the duplexer in response to a control signal of the CPU 101. A double phase power supply on/off information circuit 802 is responsive to a control signal from the CPU 101 to produce a signal which operates to connect or to cut off the power supply to the control device in the duplexer 600.

Figure 2A:
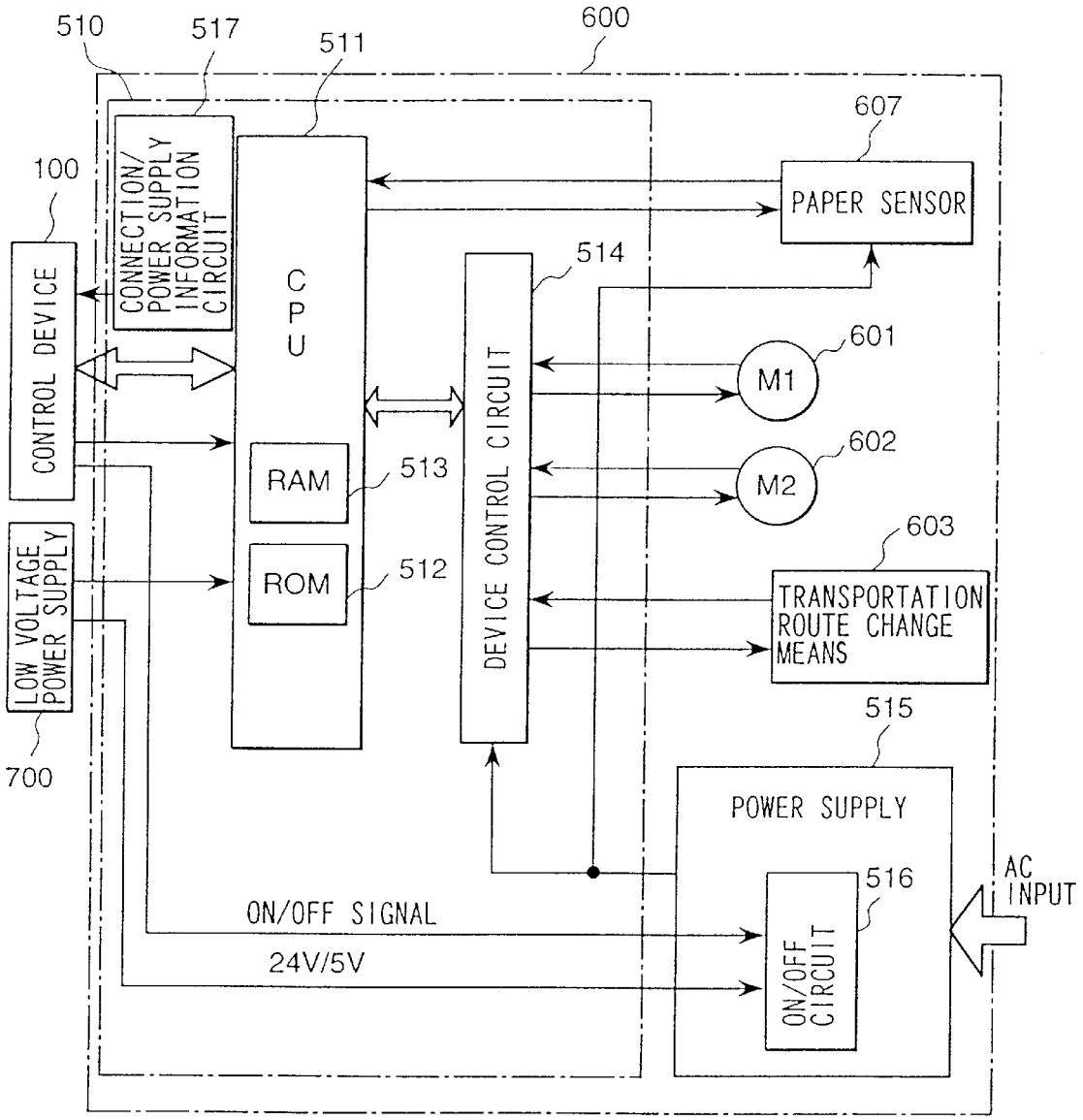
Figures 1, 2A:
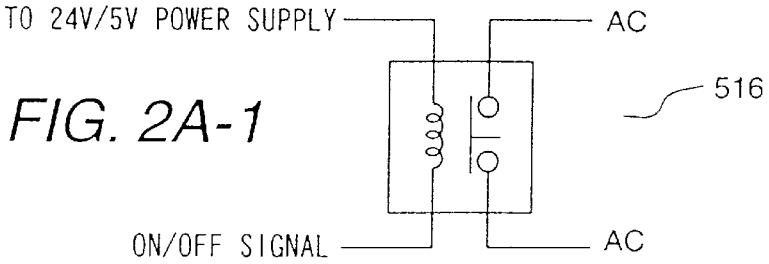

FIG. 2A is a block diagram to show the detail construction of the duplexer control device arranged in the duplexer 600 operating as an optional unit. Duplexer control device 510 has a CPU 511, and it includes a read only memory 512, that stores a control program for the CPU 511, and a random access memory 513, operating as a memory device for the work which is necessary for the CPU 511 to execute the control program. The read only memory 512 and random access memory 513 are located in the CPU 511. The CPU 511 communicates with the control device 100, and it transmits information concerning each drive unit of the duplexer, or conditions of the duplexer at the time, to the control device 100 in response to an inquiry from the control device 100. In the control device constituted to have a CPU like this example, when the power supply of the CPU is turned off in the power-saving mode, it is necessary to execute an initial process and restart the communication process with the control device 100 every time the power is provided. However, while status information concerning the unit is maintained in the random access memory in the CPU, the information is lost when the power supply is turned off. To avoid such an inconvenience, an architecture designed to not turn off the power supply of the CPU is desirable. In this example, the electric power of this CPU is received from a printer low voltage power supply 700.

A connection information/power supply information circuit 517 informs the control device 100 as to the necessity or unnecessity to connect to the duplexer or the power supply. When the electric power is to be fed, as stated above, information in this regard is sent by using this circuit. The control device 100 detects the necessity or unnecessity to connect the power supply so as supply the electric power according to the condition of this signal (for example, in the case of the power supply information: feed necessity "L"/feed unnecessity "H"). A device control circuit 514 is provided in the duplexer 600 to control the drive motors 601, 602 and the transportation route change means 603, and a drive indication signal for each motor and a control signal for controlling the transportation route change means is output under control of the CPU 511.

A power supply 515 of the duplexer 600 operates to supply the electric power to the device control circuit 514 and each component in the duplexer, such as the drive motors 601, 602. This duplexer power supply 515 operates to feed or to cut off AC power using a double sided power supply on/off circuit 516 which supplies the electric power from a low voltage power supply 700 of main body based on a control signal from the control device 100. As a result, it is constituted to turn on/off the power supply to the device control circuit 514 and the drive motors 601, 602 in the duplexer 600. One example of the double sided power supply on/off circuit 516 is shown in FIG. 2A-1. It is constituted with a relay, for example, and 5V or 24V power is supplied to it from the low voltage power supply 700 of the main body. A coil connected to it is turned on/off by the control signal from the control device 100, and the AC input unit supplied to the duplexer power supply 515 is controlled to be on/off. Thereby, the power supply from the duplexer power supply 515 can be controlled.

The double phase power supply on/off information signal 500 from the control device 100 is input to the CPU 511, and information is transmitted to the duplexer 600.

A case in which it is not desirable to turn off the CPU has been explained in detail above, however in a case where it is possible to turn off the CPU, power may be fed from the duplexer power supply 515, and a selection circuit can be provided so as to select whether power is to be fed from the low voltage power supply 700 or from the duplexer power supply 515.

Electric power necessary when each operating unit in the duplexer 600 is driven is about around 2 W in each drive means stopping generally. In a condition where the duplexer is used conventionally, it becomes a problem when there is not enough margin (more than 1 W) for the power-saving specification value, and the power-saving feature tends to turn off the duplexer if it is unnecessary.

In addition, watt consumption of the primary side for electric power generally to be used in the secondary side of the power-supply is pretty big because of its loss, and when a consumption current value in the secondary is smaller, the loss becomes larger, and it becomes 40% to 70% of the secondary current value. For example, in a case in which the consumption current value of the secondary is 24V/40 mA (circuitry current value of 24V drive parts) the 5V/40 mA (sensor consumption current), electric power of about 2.9 W to 1.6 W becomes to be used in the AC input unit of the power supply.

Therefore, if the margin for the power-saving specification value of the printer body is small, it becomes a problem. On the other hand, in this embodiment, since the operating of feed/cut is executed at the AC input unit of the duplexer power supply 515, there is no problem as stated above, and the power-saving can be executed, even if small consumption current value occurs on the secondary side.

Figure 2B:
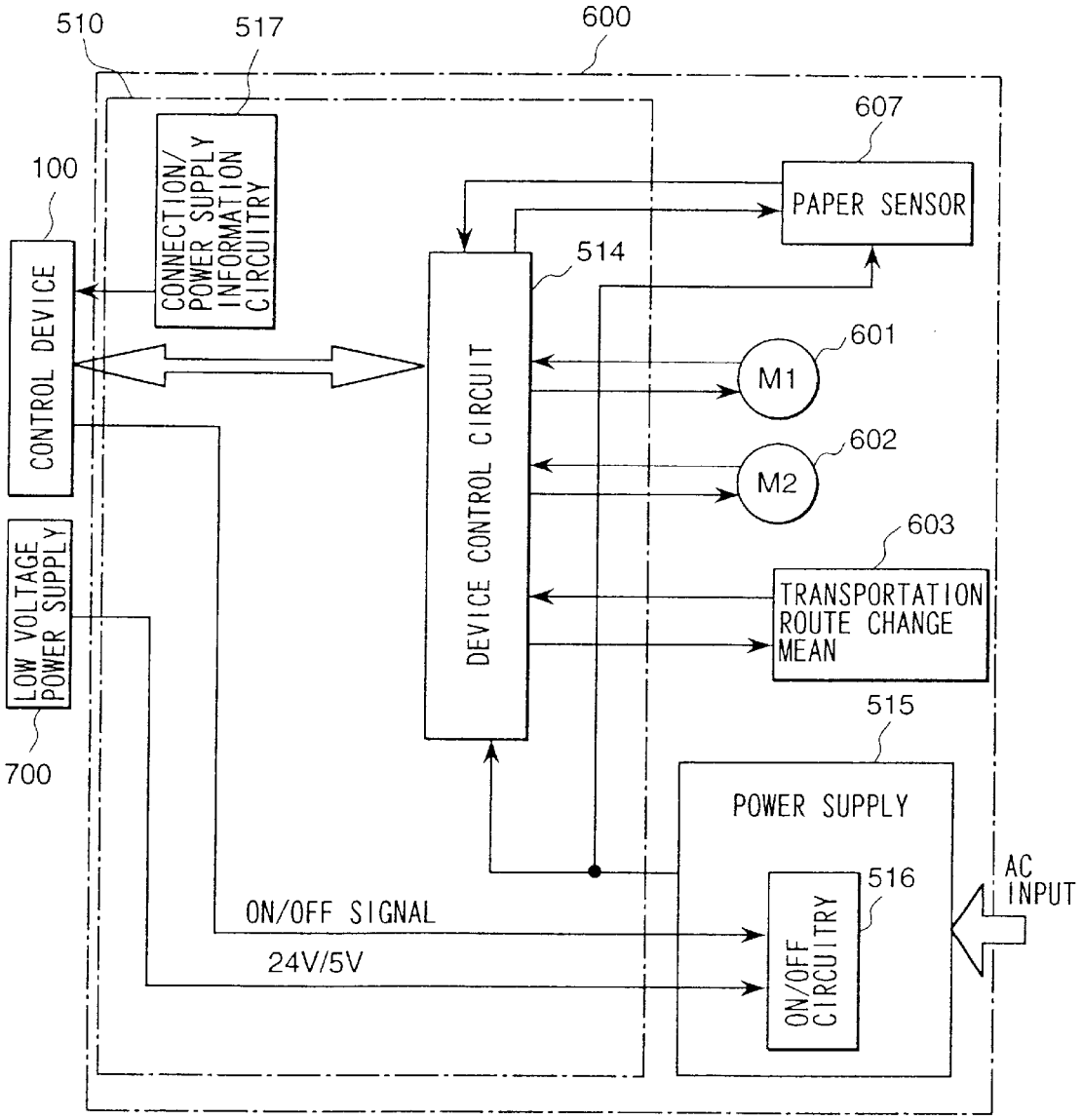

FIG. 2B shows a case in which the optional unit 600 does not have a CPU, contrary to the example described above. This example shows a case in which the power supply to supply to each component is cut off entirely. Accordingly, the connection information/power supply information circuitry 517 is set to an unnecessary condition not to feed electric power (power supply information: feed necessary "L"/feed unnecessary "H").

In addition, in a case of this example, since the device control circuit 514 in the duplexer is controlled by the control device 100, any problem of malfunction is not generated, if the off process of each component of the duplexer is executed, before the duplexer power supply is turned off.

The operation will be explained in detail with reference to FIG. 3 for a printer which is connected to an optional unit 600. Here, a case in which a CPU is provided in the optional unit 600 will be explained. First, it is judged whether the optional unit demands electric power in a process 301. When there is a request for power, the power supply circuit 801 is turned on in a process 312.

Usually the apparatus is not placed in the power-saving mode arbitrarily, and such a mode is requested in many cases by an information processor 200 of higher-order. In a process 302, whether or not a power-saving mode request has been received from this information processor 200 is judged.

When there is no request, while not explained in detail here, a normal processing of the printer is executed in a process 313. When there is a request, the motor, a fan, a clutch, a heater in the solenoid and a fixing device stop entirely in a process 303.

In a process 304 after that, an off condition is communicated to the duplexer by the double phase power supply on/off information signal 802, and in a process 305, completion of an off process is communicated from the optional unit. To complete the off process, the power supply of the duplexer is turned off at a process 306.

In a next process 307, it is judged whether or not there a request to cancel the power-saving mode has been received from the information processor 200. When there is no such request, other communication processing is executed, and the processing returns to process 307. This is because operation of the printer is not executed other than communication processing with the information processor 200 usually in the power-saving mode.

When there is a cancel release request in process 307, the request for an on process is communicated by the double phase power supply on information signal 802 in a process 308, and the on process completion is communicated from the optional unit in a process 309.

With the on process completion, the duplexer power supply is turned on in a process 310. In a process 311 thereafter, a heater and a fan of the main body are turned on, and a motor, a clutch and a solenoid are kept in a condition to be able to be turned on, so that they can be turned on in any case.

Figure 4:
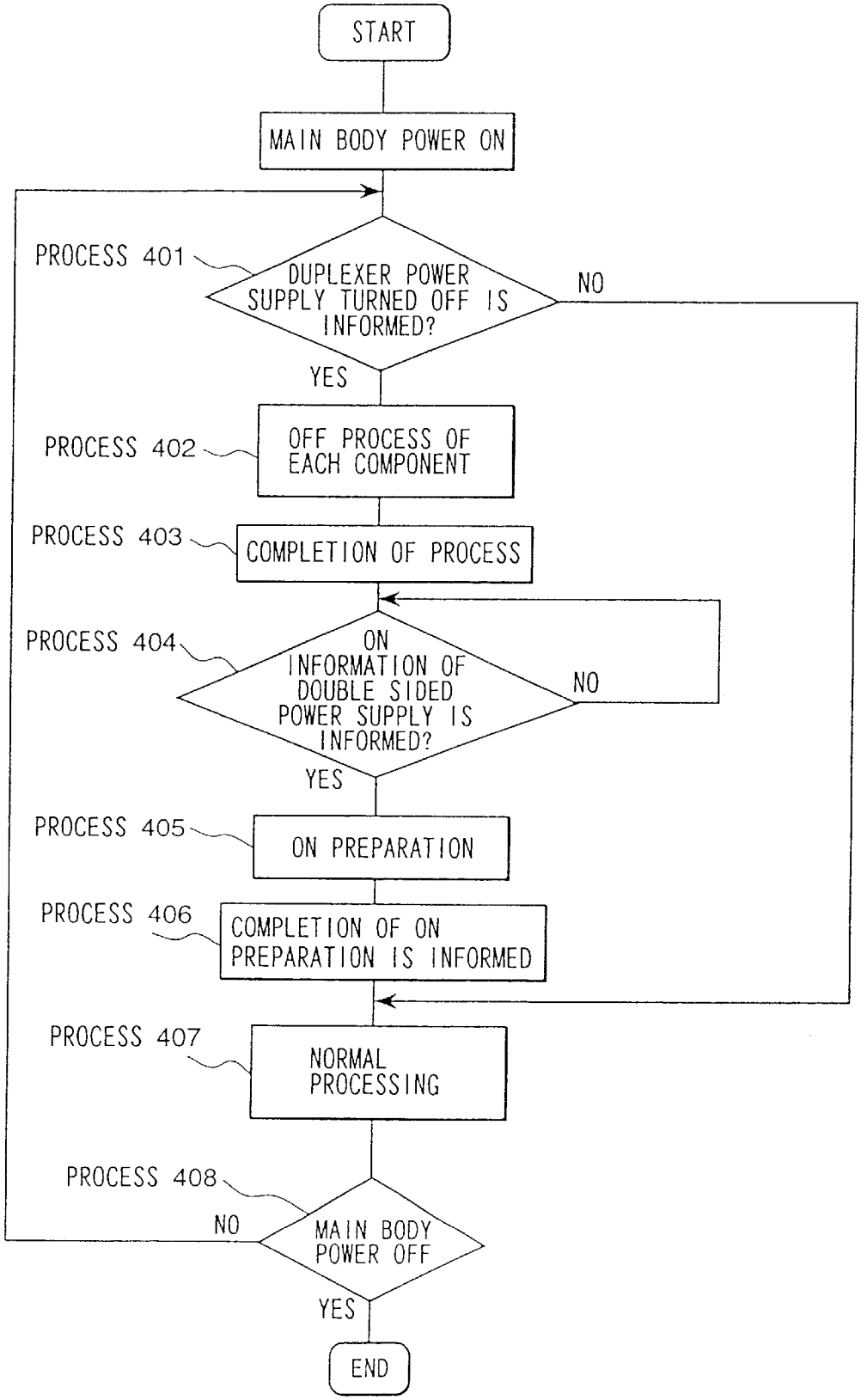
FIG. 4 is a flow chart of a control program for the control device in the duplexer of a color laser beam printer, which represents an embodiment of the present invention.

FIG. 4 illustrates the operation of the CPU 511 in the control device 510 in the duplexer 600 when the duplexer power supply is turned on/off.

Judgment as to whether the duplexer power supply is to be turned off is communicated from the control device 100 in a process 401. When there is no such information, normal processing is executed in a process 407. When there is such information, the off process of each component in the unit is executed in a process 402. The completion of the off process is communicated to the control device 100 after that in a process 403. In a process 404, a judgment is made as to whether the on information of the double phase power supply has been communicated. This process is repeated until such information is provided. When there on information has been received, in a process 405, an on preparation for the components in the unit is performed, the completion of the on preparation is communicated to the control device 100 in a process 406, and normal processing is performed in a process 407.

As stated above, before the power supply in the duplexer is turned on/off, since the on process/off process of each component in the unit is performed, a malfunction of each component can be prevented. In this embodiment, an example has been explained in detail about a case in which the power-saving mode has been employed; however, similar control may be carried out at a time when the operation of the duplexer is unnecessary, in addition to the power-saving mode condition.

As stated above, the exclusive power supply in the duplexer has a circuit structure which can select to feed/cut off power with the control device, and the circuit which turns off/feeds the power supply is constructed in the AC input unit, so that the exclusive power supply in the duplexer is turned off by the control signal of the control device, when this back-up ability is unnecessary.

Thereby, the watt consumption can be reduced by turning off the power supply in the power-saving mode, for example. Furthermore, on the occasion to feed/cut off the exclusive power supply in the duplexer, the inconvenience occurred in a case to feed/cut the power supply can be prevented by arranging signaling to indicate the process before the execution.

The present invention provides an electrophotography apparatus comprising a main body having a photoconductive body for forming an electrostatic latent image according to print data classified according to color; plural development units for performing toner developing of said electrostatic latent image; a first transfer location for copying a toner image on a photoconductive body developed by the development apparatus onto an intermediate transfer body, said intermediate transfer body receiving a toner image for each color so as to maintain it and stack color images thereon; a paper supply apparatus for supplying the paper on which a toner image is to be transferred; a transportation means to convey said paper; a transferring apparatus having a second transfer location at which said color toner image on said intermediate transfer body is transferred to said paper; a discharging apparatus to separate the paper from said intermediate transfer body after said first toner image is transferred to said paper by said transferring apparatus; a fixing means to heat and fix said toner image on said paper firmly; and a control device to control each operating element of the printer, said color electrophotography apparatus further comprising a duplexer constituted as an optional device to this color electrophotography apparatus for turning over a sheet of paper on which said first toner image has been transferred and for conveying said paper to said transportation means of said color electrophotography apparatus again, wherein said duplexer has a control device for its exclusive use and an electric power supply for its exclusive use inside of said duplexer. Furthermore, the electric power supply in accordance with the present invention has a circuit structure to selectively feed or cut off the electric power to each component in the duplexer based on a control signal by the control device in said color electrophotography apparatus.

The circuit structure selectively feeds said electric power for each component of said duplexer from the electric power supply provided in said color electrophotography apparatus, and said color electrophotography apparatus has a structure to select whether said electric power is to be fed from the electric power supply provided in said duplexer or from the electric power supply provided in said color electrophotography apparatus. Furthermore, said duplexer indicates to said control device of said color electrophotography apparatus whether said electric power is to be fed or not from said electric power supply of said color electrophotography apparatus according to the constitution of said duplexer.

The control device of said color electrophotography apparatus has a detection means to detects whether said duplexer is to be connected or not connected to said color electrophotography apparatus and to detect whether said power supply is to be fed or not fed from said color electrophotography apparatus to each component, whereby said color electrophotography apparatus detects a condition of said duplexer, and based on the detected condition, said power supply is selected.

The control device of said color electrophotography apparatus has a detection means to detect whether said duplexer is connected or not to said color electrophotography apparatus, wherein when said color electrophotography apparatus is in a power-saving mode so that said duplexer is not being operated, said power supply in said duplexer is switched off in response to a control signal.

Furthermore, information is transferred from said control device in said color electrophotography apparatus to said control device in said duplexer beforehand, before said circuit structure selects feed/cut off of said electric power.

In addition, said electric power supply inside of said duplexer for exclusive use of the components therein is controlled to be fed or cut off at the AC input unit of the first side of the electric power supply. Accordingly, when the function of the unit is unnecessary, for example, in a power-saving mode, the watt consumption can be reduced by turning off the power supply in the duplexer with the control signal of the control device. This is useful for the power-saving feature, and an inconvenience in the case of feed/cut off of the power supply can be prevented.

What is claimed is:

1. An electrophotography apparatus, comprising:

a main body having an exposure means to generate a light flux, a photoconductive body for forming a latent image using said light flux, a development device for developing said latent image on said photoconductive body, a transfer device for transferring an image developed by said development device onto a recording medium, a fixing device for fixing said image on said recording medium, and an optional apparatus mounted to said main body, said optional apparatus having an exclusive power supply utilized exclusively for said optional apparatus, wherein said main body transmits a switching over instruction to said optional apparatus according to the kind of said optional apparatus when said optional apparatus is mounted to said main body, and said optional apparatus is switched over by said switching over instruction so that said optional apparatus is supplied power from a power source of said main body.

2. An electrophotography apparatus as defined in claim 1, wherein said optional apparatus is a duplexer which controls the movement of a recording medium having a pictorial image on one face thereof so that another pictorial image is transferred onto the other face thereof.

3. An electrophotography apparatus as defined in claim 1, wherein said main body saves electric power in a power-saving mode.

4. A color electrophotography apparatus, comprising:

a main body having a photoconductive body for forming an electrostatic latent image according to print data classified according to color;

plural development units for performing a toner development of said electrostatic latent image;

first transfer location for transferring a toner image on said photoconductive body, developed by said development units, to an intermediate transfer body, said intermediate transfer body receiving successive color toner images so as to form a composite toner image by stacking successive color toner images;

a paper supply apparatus for supplying paper on which said composite toner image is to be transferred;

a transportation means to convey said paper;

a transfer device at a second transfer location for transferring said composite toner image on said intermediate transfer body onto said paper;

a fixing means to heat and fix said composite toner image on said paper firmly;

a control device for controlling each of said transportation means and said fixing means; and a duplexer which turns over said paper on which said composite toner image is fixed and conveys said paper to said transportation means of said color electrophotography apparatus again; wherein said duplexer has a control device and an exclusive electric power supply inside of said duplexer for their exclusive use;

said exclusive electric power supply has a circuit structure to selectively feed/cut off an electric power from said exclusive power supply for each component of said duplexer, under control of said control device in said main body;

said circuit structure selects to feed said electric power for said each component of said duplexer from an electric power supply provided in said main body;

said main body has a structure to select whether said circuit structure receives said electric power from said exclusive electric power supply provided in said duplexer or from said electric power supply provided in said main body; and information is communicated from said control device in said main body to said control device in said duplexer beforehand, before said circuit structure selects feed/cut off of said electric power.

5. A color electrophotography apparatus as defined in claim 4, further comprising:

means provided in said duplexer to indicate to said control device of said color electrophotography apparatus whether or not said electric power is to be fed from said electric power supply of said main body according to the constitution of said duplexer.

6. A color electrophotography apparatus as defined in claim 4, said control device of said main body comprising:

detection means to detect whether said duplexer is to be connected or not connected to said main body and to detect whether power is to be fed or not fed from said main body to said each component, whereby said main body detects a condition of said duplexer, and based on the detected condition, said power supply is selected.

7. A color electrophotography apparatus as defined in claim 4, comprising:

detection means to detect whether said duplexer is to be connected or not connected to said main body, and when said main body is in a power-saving mode so that said duplexer is not being operated, said exclusive power supply in said duplexer is switched off in response to said control signal.

8. A color electrophotography apparatus as defined in claim 4, wherein an AC input of said exclusive electric power supply provided inside of said duplexer for its exclusive use is fed or cut off according to said control signal from said control device in said main body.

9. A color electrophotography apparatus as defined in claim 4, wherein said duplexer is connected to said main body without changing any construction of said main body, as a user option.

10. A color electrophotography apparatus as defined in claim 4, wherein said duplexer is connected to said main body by at least partially changing the construction of said main body as a maker option.

11. An electrophotography apparatus as defined in claim 4, further comprising an optional component of said color electrophotography apparatus having an exclusive power supply thereinside.

* * * * *